US005779546A

United States Patent [19]

Meissner et al.

[11] Patent Number: 5,779,546

[45] Date of Patent: Jul. 14, 1998

[54] AUTOMATED GAMING SYSTEM AND METHOD OF AUTOMATED GAMING

[75] Inventors: Garry D. Meissner, Egg Harbor Township; Peter Fayter, Collingslakes, both of N.J.

[73] Assignee: FM Gaming Electronics L.P., Egg Harbor Township, N.J.

[21] Appl. No.: 790,058

[22] Filed: Jan. 27, 1997

[51] Int. Cl.[6] ..... A63F 1/18; A47B 25/00

[52] U.S. Cl. ..... 463/25; 463/42; 463/29; 273/309; 273/149 R; 273/198 A

[58] Field of Search ..... 463/25, 29, 12, 463/42; 273/292, 143 R, 274, 309, 138.2, 148 A, 149 R

[56] References Cited

U.S. PATENT DOCUMENTS

| | | | |
|---|---|---|---|
| 4,072,930 | 2/1978 | Lucero et al. | 463/47 |
| 4,108,361 | 8/1978 | Krause | 463/25 |
| 4,120,004 | 10/1978 | Coutta | 348/150 |
| 4,283,709 | 8/1981 | Lucero et al. | 463/25 |
| 4,339,798 | 7/1982 | Hedges et al. | 364/412 |
| 4,531,187 | 7/1985 | Uhland | 364/412 |
| 4,659,082 | 4/1987 | Greenberg | 273/149 R |
| 4,662,637 | 5/1987 | Pfeiffer | 273/149 P |
| 4,667,959 | 5/1987 | Pfeiffer et al. | 273/149 R |
| 4,755,941 | 7/1988 | Bacchi | 364/412 |
| 4,926,327 | 5/1990 | Sidley | 364/412 |
| 4,951,950 | 8/1990 | Normand et al. | 273/149 P |
| 4,964,638 | 10/1990 | Ishida | 463/27 |
| 5,054,787 | 10/1991 | Richardson | 273/269 |
| 5,067,713 | 11/1991 | Soules et al. | 273/149 P |
| 5,110,134 | 5/1992 | Laughlin et al. | 273/293 |
| 5,114,153 | 5/1992 | Rosenwinkel et al. | 273/292 |
| 5,116,055 | 5/1992 | Tracy | 463/27 |
| 5,119,295 | 6/1992 | Kapur | 364/412 |
| 5,121,921 | 6/1992 | Friedman et al. | 273/149 P |
| 5,179,517 | 1/1993 | Sarbin et al. | 314/410 |
| 5,199,710 | 4/1993 | Lamle | 273/149 R |
| 5,216,595 | 6/1993 | Protheroe | 964/412 |
| 5,265,874 | 11/1993 | Dickinson et al. | 463/42 |
| 5,280,909 | 1/1994 | Tracy | 463/27 |
| 5,344,144 | 9/1994 | Canon | 463/27 |
| 5,570,885 | 11/1996 | Ornstein | 463/27 |
| 5,586,766 | 12/1996 | Forte et al. | 273/309 |
| 5,586,936 | 12/1996 | Bennett et al. | 463/25 |
| 5,605,334 | 2/1997 | McCrea | 273/309 |

OTHER PUBLICATIONS

Bally's Park Place Casino Hotel & Tower, "Gaming Guide" (1996).

*Primary Examiner*—Benjamin H. Layno
*Attorney, Agent, or Firm*—Ratner & Prestia

[57] ABSTRACT

A method and apparatus enable a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards which are dispensed by the automated dealing shoe.

29 Claims, 12 Drawing Sheets

AUTOMATED GAMING SYSTEM AND METHOD OF AUTOMATED GAMING

FIELD OF THE INVENTION

The present invention relates to gaming systems, and in particular to systems for automated gaming. Specifically, a method and apparatus are disclosed for automating casino card games.

BACKGROUND OF THE INVENTION

Casino card games, such as the basic game of blackjack, have been played with little change since their inception. Specifically, due to the physical characteristics associated with the games (e.g. the forms of wagering, the amounts of betting pay-offs and the speed of dealing), the games have varied little in style of play. In attempts to change these physical characteristics, one option which has proved successful has been the use of a dealing shoe.

An exemplary dealing shoe 100 in accordance with the prior art is shown in FIG. 1. Multiple decks (e.g. six or eight) of cards may be placed into this dealing shoe. The dealer can then dispense the cards from this dealing shoe without actually holding the cards. Such a dealing shoe is manufactured (for example) by Paulson Gaming Supply, Las Vegas, Nev.

Playing cards (not shown) are placed in front of slide 102. Slide 102 includes a roller (not shown) which is in contact with a surface (not shown) beneath slide 102. The surface is angled downward towards exit chute 104. Slide 102 may also be heavily weighted. Because slide 102 resides on an angled surface, it is urged by gravity towards exit chute 104. The playing cards are placed in piled form on top of slide 102. As a card is removed by the dealer from exit chute 104, slide 102 pushes the remaining cards forward and into position for the next card removal.

One reason for using the shoe in a casino environment is to stop cheating by both the dealer (i.e. the casino employee) and the player (i.e. the casino patron). Because most shoes hold multiple decks of cards, it is difficult for a player counting cards (a "card counter") to keep track of the remaining cards to be dealt and possible combinations of those remaining cards. Also, by using the shoe, the cards are kept away from the dealer's constant touch. This decreases the dealers ability to wrongfully manipulate the cards.

Another reason for using the shoe in a casino environment is to enable a greater number of hands to be dealt between shuffles. Although increasing the number of decks in use results in increased shuffle time, however, the amount of time between shuffles is of greater impact to the number hands which may be dealt within a predetermined time period. By decreasing this "between shuffling" time, playing time can be extended with little or no interruptions. Specifically, decreasing this time allows a dealer to have better control over the speed of the game for longer periods of time. This in turn allows the dealer to quicken the pace of the game and to increase pressure on each player, which in turn can be disruptive to both a player's betting and playing style. Such a disruption can have a positive effect on the number of hands won by the casino.

The average number of hands dealt per hour is typically from 60 to 80. The casino's win calculations may be based on that number. The average win for a casino is typically 1% of the monies bet. Thus, increasing the number of deals per hour or the size of bets per deal increases the amount of revenue generated.

Due to the physical limitation of the way the games are played and cards are dealt, it is difficult to change the number of deals per hour.

The average calculation for the casino winnings for blackjack in a one hour period for a $5 average bet is presented below:

7-players×70 deals/hour×$5 average bet×1%=$24.50 per hour casino win.

The cost for a casino to run a blackjack table is about $18.95 per hour. This includes paying personnel such as Dealer, Supervisors, Pit Boss, Shift Manager, Casino Manager and Casino Administration, as well as overhead, which includes paying for Accounting personnel, Security personnel, Surveillance personnel, equipment upkeep and Housekeeping for cleaning.

Another factor in the cost to run a blackjack table is complimentary services and items given to the players. These services ("comps") are based on the estimated loss of the player and can be 30% of their loss. The estimated loss is obtained through observation by the Dealer, Supervisor and/or Pit Boss. Note, however, that the loss is only an estimate. The inventors are not aware of a method in the prior art to obtain an accurate record of a player's financial status, other than by having a person watch and record the player's every play on a continual basis. This comprehensive gathering of play is not done, due to the number of personnel required and the cost of salaries. Instead, a limited observation is made of the person's average bet and style of play. The casino then tries to track the length of play by that patron. After the length of the play is determined, the casino uses a calculation (based on style of play and average bet) to determine an estimated total win or total loss for that person. The casino then issues comps on that basis. Casinos do not have sufficient staff to constantly watch and record every play of every player at every table; nor is it practical to do so.

The aforementioned method of issuing comps is neither dependable, accurate, efficient or secure, since it depends upon individual observation, interpretation and honesty. Unfortunately, certain players may be given too many comps, while other players may be given too few comps. The players given too many comps will keep playing and will receive further excessive comps at a net loss to the casino. The players given too few comps are subject to inducements by other casinos where they may receive more comps, thus causing them to play at another casino.

The overall cost of running table games is quite high. Furthermore, the cost can fluctuate substantially because of decisions that are made based on very few known facts. The actual costs and profits are never really known until the casino Accounting department reviews records, performs calculations and makes determinations on actual markers.

Automated card machines, such as personal blackjack machines and poker machines are also found in casinos. Typically, they have the appearance of a slot machine and are found in the area of the casino which is populated by slot machines. Automated card machines are not popular with all players, because actual cards are not dealt and there is no direct involvement with other players.

SUMMARY OF THE INVENTION

A method and apparatus enable a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards which are dispensed by the automated dealing shoe.

BRIEF DESCRIPTION OF THE DRAWINGS

The present invention will now be described by way of non-limiting examples, with reference to the attached drawings in which.

DETAILED DESCRIPTION OF THE INVENTION

The present invention relates to a gaming system which is particularly useful in casino environments and for use with card games. The description below describes the invention being used to automate the game of blackjack. It is understood, however, that the invention may be used with any card game, and in any environment.

Briefly, according to one aspect of the present invention, a computer system is disclosed which enables a player to wage a bet, identify himself to the computer system, have his play monitored and instruct the dealer.

Figure 2:
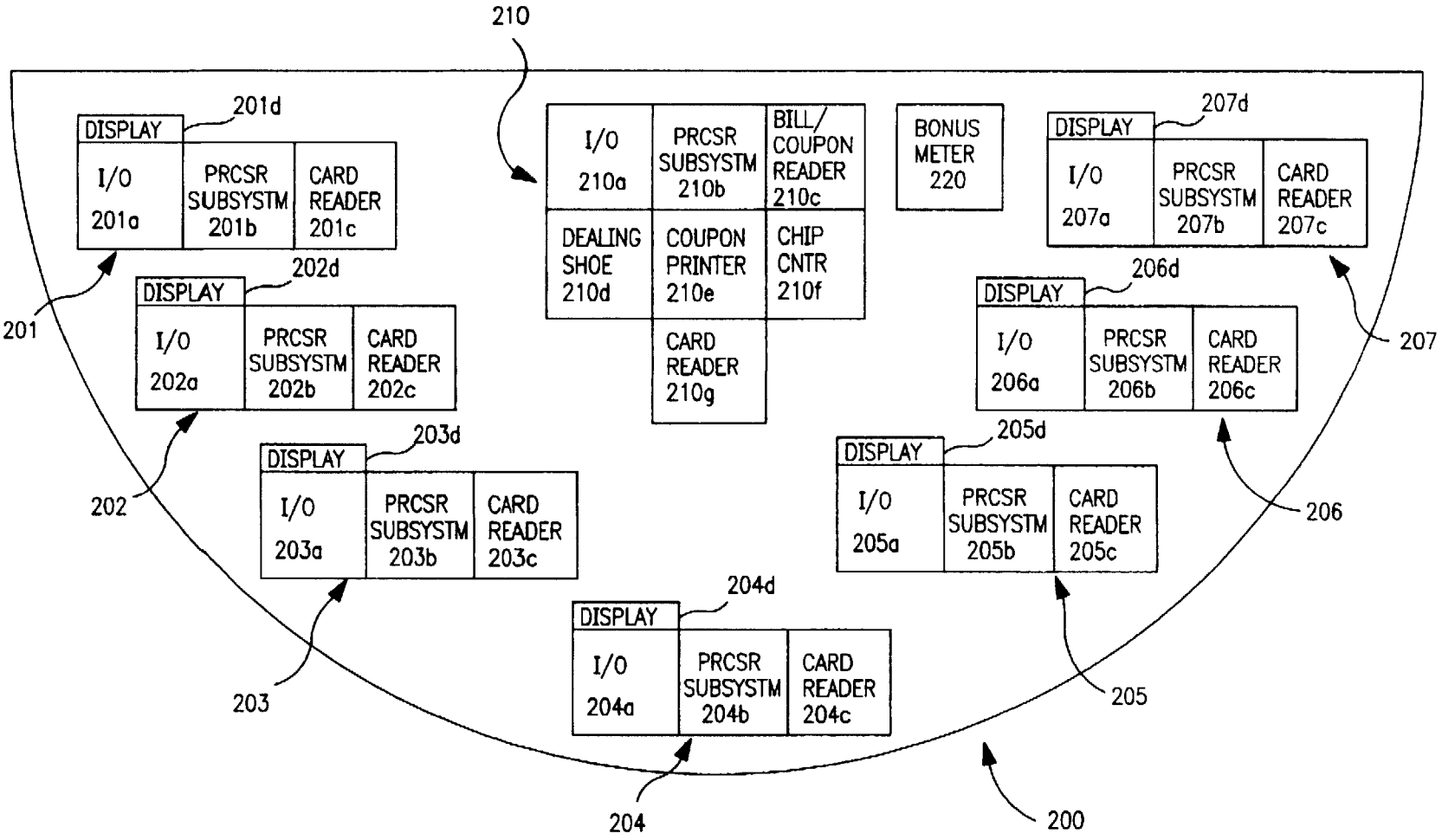
FIG. 2 is a block diagram of an exemplary card playing table in accordance with the present invention.

A blackjack table 200 in accordance with the present invention is shown in FIG. 2. The basic configuration of the table 200 consists of, for example, seven player betting stations 201–207 and one dealer control station 210. Each of these stations 201–207 and 210 are configured with the following hardware and capabilities:

BETTING STATIONS 201–207

Touch Screen 201*a*–207*a*

An Input/Output (I/O) device such as a touch screen sensing and display system may be the interaction point of the player to the game.

Display 201*d*–207*d*

The display may be, for example, an LED display and may be positioned on the dealer's side of each player's touch screen (or elsewhere in a location visible to the dealer). The display is utilized as a quick reference source of instructions for the dealer for certain player choices such as: active, inactive, Hit, Stand, Split, etc.

Card Reader 201*c*–207*c*

This enables the player to be identified. A card reader attached at each patron station is an example of how player identification may be accomplished.

Processing Subsystem 201*b*–207*b*

This keeps track of player cards, player credits and player instructions.

CONTROL STATION 210

Touch Screen 210*a*

An I/O device such as a touch screen sensing and display system is utilized for all dealer interaction, authorizations and over-rides.

Processing Subsystem 210*b*

This keeps track of dealer cards and dealer instructions.

Bill/Coupon Reader 210*c*

This is the reader input station for currency and coupons. By placing currency or coupons into the reader, the player receives a credit which may be used towards game play.

Automated Dealing Shoe 210*d*

This is the point of card identification and distribution.

Coupon Printer 210*e*

This is for the printing of cashed out credits which could be turned in at a main pay station to be converted into cash or be carried over to another table, slot machine or other gaming devices where it could be read and downloaded as credits into another game.

Chip Counter 210*f*

An optional chip counter with downloading capabilities is utilized for the acceptance of chips from other tables that are not upgraded for automated play and coupon dispensing.

Card Reader 210*g*

This enables the dealer to be identified. A card reader attached at the dealer station is an example of how dealer identification may be accomplished.

A host (main) computer (not shown) may also be included. An example host computer is a personal computer using a microprocessor such as an Intel Pentium™ configured as understood by those skilled in the art. Other examples of host computers will be understood by those skilled in the art. Betting stations 201–207 and control station 210 may each communicate between themselves either directly or via the host computer.

In one exemplary embodiment of the present invention, there may be as many as seven players to a table 200. Each player is assigned a section 201–207 of the table. A section 210 of table 200 is also assigned to the dealer. A player betting station consisting of a touch screen (as an exemplary input device), processing subsystem and a card reader is located at each player section. An additional touch screen is mounted in the dealer's section to allow for the control of the game by the dealer when required. Also, a display 201*d*–207*d* consisting of a row of three light emitting diodes (LEDs) is connected to the back of each player's touch screen so as to be visible by the dealer. These LEDs provide instructions to the dealer to advise him of the player's intentions (hold, deal, split, insurance, etc.).

An example of touch screen 201*a*–207*a* is a 6 line×40 character vacuum florescent display. The display is fully programmable so that a wide variety of message and display options are available. The player is prompted for options on this screen. Selecting an option is accomplished by touching a location on the screen which selects the option corresponding to that location. The screen communicates via an RS232 attachment and uses RTS/CTS handshaking.

Card reader 201c–207c can be a standard magnetic strip, barcode style or laser optical type reader. The output of the reader is an RS232 interface which transmits a REQUEST TO SEND signal to indicate that data is available to be sent to the main computer.

Figure 3:
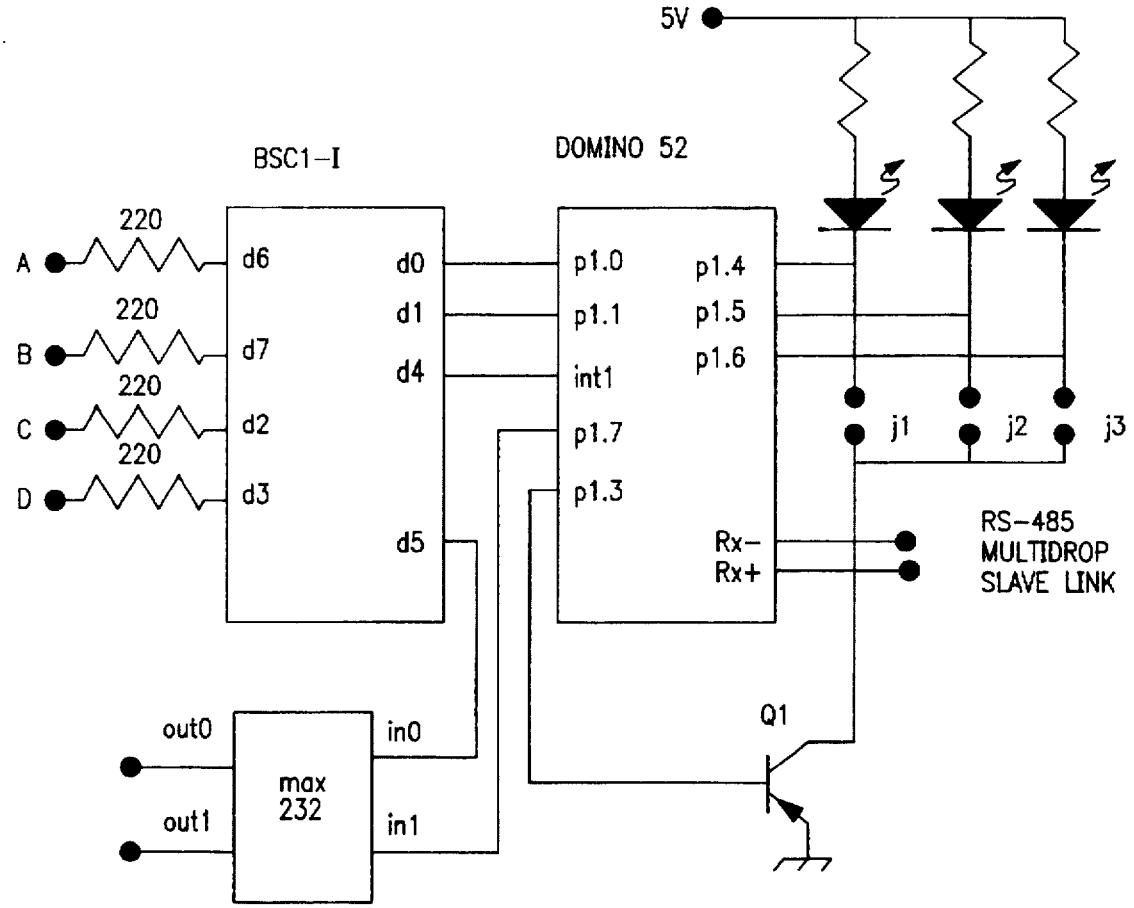
FIG. 3 is a circuit diagram of the control logic for a processing subsystem in accordance with the present invention.

A processing subsystem 201b–207b is located at each play section and is used for controlling each touch screen, receiving information from each card reader and communicating with a host computer. In an exemplary embodiment, each processing subsystem includes a Domino 52C microprocessor (manufactured by Micromint Corporation) connected to a BSC1-IC microprocessor (manufactured by Parralax, Inc.). The circuit for this is shown in FIG. 3. The host computer and all of the processing subsystems communicate with each other along a common network. The address of each processing subsystem is determined by each subsystem's respective setting of j1, j2 and j3. Upon initialization, the Domino 52C microprocessor sets p1.3 (port 1, bit 3) and causes Q1 to conduct providing a path between the LEDs on p1.4, p1.5 and p1.6 when the jumpers are connected. The program then reads p1.4, p1.5 and p1.6 to determine its address. Once the address is know, p1.3 is reset and the LEDs are controlled from port 1, bits 4–5 and 6. The LEDs are used during the initialization process to aid in diagnosing failures should the need arise. The BSC1 chip acts as a dual UART (universal asynchronous receiver transmitter) in this configuration. RS232 inputs are taken on input lines A and B. Requests for attention are accepted on inputs C and D. A MAX232 chip, manufactured by the Maxim Company, is used to convert signals sent from the BC52 p1.7 to RS232C levels. This is the output line to the touch screen (out1). The MAX232 is also used to take output from the BSC1D5 line and convert it to RS232C levels. This port is the CTS (clear to send) signal used to signal the touch screen that it is time to send its data to the BSC1. Data are transferred from the BSC1-IC microprocessor to the DOMINO 52C microprocessor synchronously using p1.1 as a clock and p1.0 as a data lead. The D4 to INT1 connection is asserted by the BSC1-D4 port to cause an interrupt on the DOMINO 52C to indicate that there is data available.

Each microprocessor contains a program that is stored in Electrically Erasable Programmable Read Only Memory (EEPROM), providing persistent storage even when power is removed. The program for the BSC1-IC acts as a dual RS232 input port and outputs its data to the connected DOMINO 52C.

The DOMINO 52C microprocessor establishes a connection with the host computer and handles most game functions. The DOMINO 52C microprocessor maintains a set of arrays that map X-Y coordinates from the touch screen into an index. The Array, for example, looks like Table I below:

TABLE I

| | | | | | | | | | | | | | | | | | | | | | | | | | |
|---|---|---|---|---|---|---|---|---|---|---|---|---|---|---|---|---|---|---|---|---|---|---|---|---|---|
| 0 | 0 | 1 | 1 | 1 | 0 | 0 | 0 | 0 | 0 | 0 | 0 | 3 | 3 | 3 | 0 | 0 | 0 | 0 | 0 | 0 | 0 | 0 | 0 | 0 | 0 |
| 0 | 0 | 1 | 1 | 1 | 0 | 0 | 0 | 0 | 0 | 0 | 0 | 3 | 3 | 3 | 0 | 0 | 0 | 0 | 0 | 0 | 0 | 0 | 0 | 0 | 0 |
| 0 | 0 | 1 | 1 | 1 | 0 | 0 | 0 | 0 | 0 | 0 | 0 | 3 | 3 | 3 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 9 | 9 | 9 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 9 | 9 | 9 |
| 0 | 0 | 2 | 2 | 2 | 0 | 0 | 0 | 0 | 0 | 0 | 0 | 0 | 0 | 0 | 0 | 0 | 0 | 0 | 0 | 0 | 0 | 0 | 9 | 9 | 9 |
| 0 | 0 | 2 | 2 | 2 | 0 | 0 | 0 | 0 | 0 | 0 | 0 | 0 | 0 | 0 | 0 | 0 | 0 | 0 | 0 | 0 | 0 | 0 | 9 | 9 | 9 |
| 0 | 0 | 2 | 2 | 2 | 0 | 0 | 0 | 0 | 0 | 0 | 0 | 0 | 0 | 0 | 0 | 0 | 0 | 0 | 0 | 0 | 0 | 0 | 9 | 9 | 9 |

In an exemplary embodiment of the present invention, the screen has 10 rows by 27 columns that may be sensed when touched. The array directly maps the X-Y coordinates to a number used to determine what action to take. Because there may be as many as 127 messages stored by the screen, there will be an option array for every different type of input arrangement used. The association between option arrays and message type is maintained by a separate array that looks like the exemplary message array shown in Table II below.

TABLE II

| | | | | | | | | | |
|---|---|---|---|---|---|---|---|---|---|
| 1 | 1 | 1 | 2 | 1 | 3 | 1 | 2 | 1 | 1 |

Each element (block) represents a message number, the data contained in each element indicates which option array to use to determine the representation of the data input. This array extends to 127 elements. Using these two arrays, the DOMINO can determine how to respond to each message. The keeps track of the state of each game and the current message displayed on the screen. Two variables are used for this purpose, STATES and MSG. MSG is the last message sent to the display and STATE is the result of player inputs. Valid game states are as follows:

1. Idle—the unit is not being used by a player. Promotional messages may be displayed.
2. Card In Wait—An identification card has been placed into the player identification card reader. The card reader has transmitted player identification to the host computer. The touch screen is waiting to receive a credit limit authorization.
3. Play Authorized—The player has received a credit authorization and a hand is about to be dealt. The player may enter instructions.
4. Player Wager—A game has started, a hand is about to be dealt, and the player is placing a bet.
5. Dealing in progress—Hand dealing has been started before any other option has been taken from this station. The player is inhibited from entering instructions.
6. Taking Card—The player has requested a card in the current game.
7. Split—The player has requested that the dealer split the hand.
8. Insurance—The player wishes to insure the hand.

Each processor subsystem (e.g., 201b) may be in any of these states.

Messages and states are very often related so that an array is maintained for the processor to determine what message should be sent based on the state of the game, and consequently how to handle the input. The STATE ARRAY looks like Table III below.

TABLE III

| | | | | | | | | | |
|---|---|---|---|---|---|---|---|---|---|
| 1 | 6 | 2 | 3 | 5 | 1 | 10 | 8 | 2 | 7 |

Figure 4:
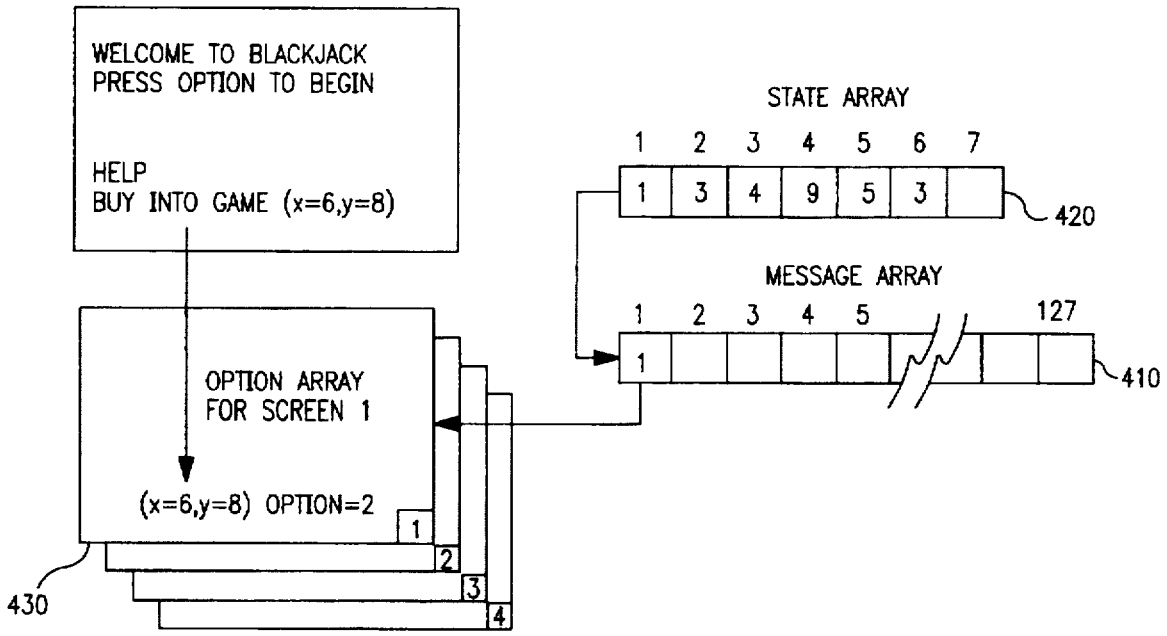
FIG. 4 illustrates the interaction between the display and each of the option array, state array and message array.

FIG. 4 illustrates the relationship between the displays and each of the option array, the state array and the message array. Each possible state which the processor subsystem may be in is represented by state array 420. Each possible displayed message is represented by message array 410 (i.e. each location in message array 410 references a respective message). Each entry in state array 420 "points" to a respective location in message array 410. Each location in message array 410 includes a respective index value which "points" to a respective message. Each location in option array 430 includes a mapping of screen locations to various states. Thus, each location in option array 430 corresponds to a respective displayed message and hence a respective location in message array 410.

In the example shown in FIG. 4, display (e.g., 201*d*) is displaying a message corresponding to state 1. The message is displayed as a result of being indicated for display by message array 410. State array location 1 "points" to location 1 in message array 410. Location 1 in message array 1 "points" to the (for example) "Welcome to Blackjack" message as well as location 1 in option array 430. Location 1 in option array 430 indicates that if the user touches the "Buy Into Game Text" (e.g. at physical location x=6, y=8) then the processor subsystem (e.g., 201*b*) will transition into state 2.

Since the game is played with credit, the credit line is established by the host computer and sent to the processing subsystems for local storage. The processing subsystems keep track of the wins/losses and forward this data to the host computer as well. The processing subsystem keeps track of the player's activity and receives a card identification signal as each card is dealt. Each card for the entire hand is stored by each processing subsystem including the dealers' cards. The dealer knows which player to deal to by looking at the LEDs on the touch screen. At the completion of each hand the dealer may signal, by way of the dealer's touch screen 210*a* that the hand is complete. Upon being signaled that the hand is complete, the dealer's processing subsystem 210*b* may poll each processing subsystem 201*b*–207*b*. After each processing subsystem 201*b*–207*b* has been polled, processing subsystem 201*b*–207*b* calculates wins/losses based on, for example, the value of the players' cards in comparison to the value of the dealers' cards. The dealer's processing subsystem 210*b* calculates all the win/loss values and then polls each station in turn to make sure that the amount calculated by each processing subsystem 201*b*–207-*b* matches the amount calculated by the dealer's processing subsystem 210*b*. In this manner, error checking is realized. If the amounts do not match, then an error message is sent to the dealer's touch screen so that the error may be handled.

By automating the card dealing process, cards may be identified, dealer proficiency can be monitored and players' wins or losses may be tracked. In this manner, accurate information regarding each player and dealer may be obtained. Also, by automating the identification and tracking process, it may be possible to cut the overhead of personnel, increase the speed and betting of the game, give comps to patrons based on actual losses. It may also be possible to provide improved security from theft by players or employees, increase the ease with which the player can move from game to game, table game to slots or slots to table game through the common use of credits. This is because a player may no longer need to utilize specific chips, tokens, plaques or denomination of currency to initiate play at particular gaming devices.

Playing card identification is accomplished using an automated dealing shoe (ADS) 200. Automated dealing shoe 200 automatically advances and interprets the value of a playing card and provides an interface to a computing system. Furthermore, automated dealing shoe 200 is a general purpose device suitable for many different types of card games.

Figure 1:
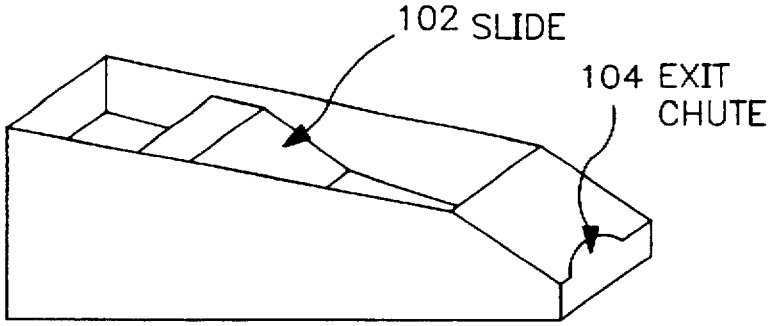
FIG. 1 is a perspective drawing of a dealing shoe in accordance with the prior art.
Figure 5A:
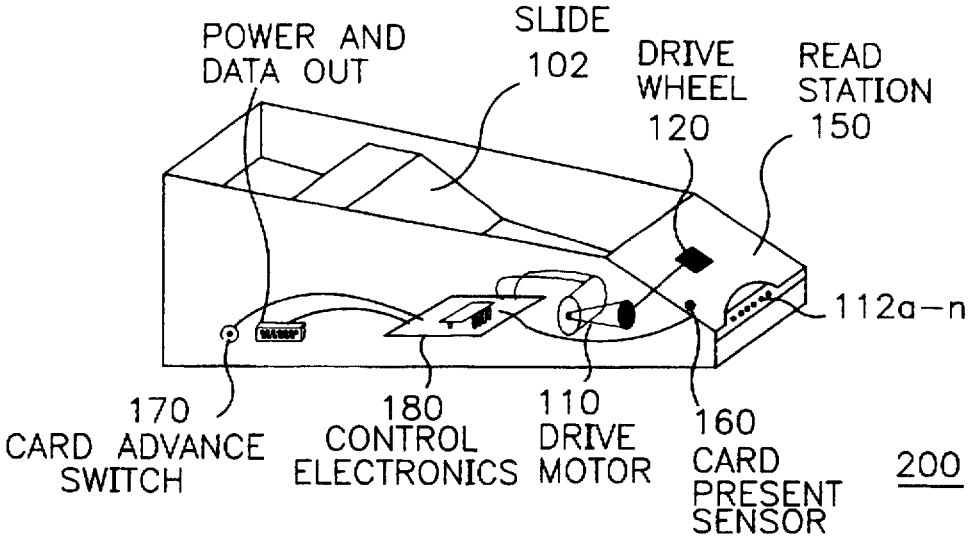
FIG. 5*a* is a perspective drawing of an automated dealing shoe in accordance with the present invention.

FIG. 5*a* illustrates automated dealing shoe 200. As shown, the standard shoe 100 of FIG. 1 which has been modified to accommodate a drive motor 110 and optical sensors 112*a*–112*n* to determine the value of the dealt card. Furthermore, a drive wheel 120 has been placed into exit chute 104, and read station 150 with optical sensors 112*a*–112*n* has been placed in the card's path. Slide 102 pushes the cards against drive wheel 120. When drive motor 110 is energized, drive wheel 120 advances the card across read station 150 where the card is sampled. The resulting data which indicates the card value is sent to control electronics 180. Card present sensor 160 detects the entry of a card into exit chute 104. The data is stored in control electronics 180 and later forwarded to the host computing system (not shown). Card advance switch 170 may be connected to either a foot switch (not shown) or touch plate (not shown) and is used to start a read cycle.

Figure 5B:
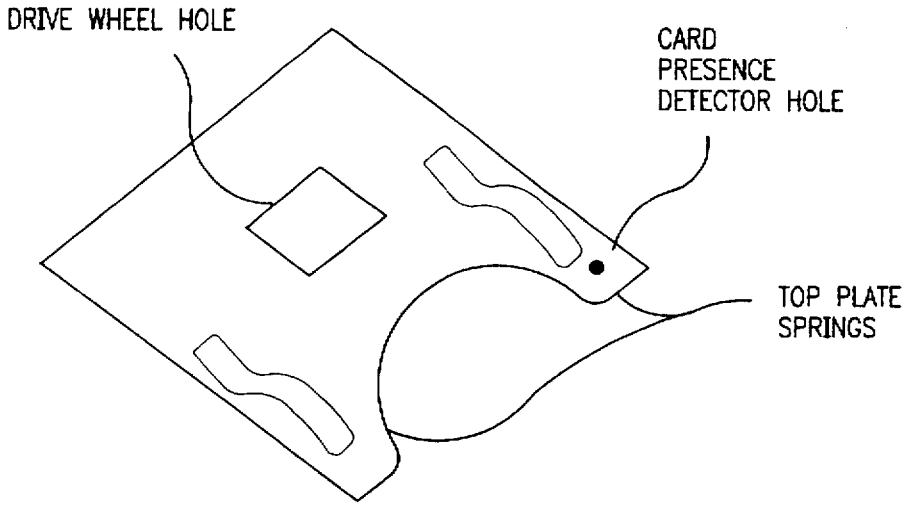
FIG. 5*b* is a perspective drawing of the top plate assembly used in the automated dealing shoe of FIG. 5*a*.

Drive motor 110 provides a constant velocity across read station 150 which is required for proper read timing. As an option, an additional chute (not shown) may be added to the exit path to provide automatic sensing when cards are removed, cycling the reader and thereby eliminating the card advance switch. The focal length of the optical reader is desirably 3 mm. The read station optics are mounted to Plexiglas to maintain this length. The card is held against the Plexiglas by way of two flat, leaf-type springs 300, connected to top plate 302 as shown in FIG. 5*b*.

Playing cards are pushed through the exit chute sideways. The width of a typical playing card is 2500 mills or 2.5 inches. Drive motor 110 desirably moves a card across the read station heads and through the exit chute in 1 second. The diameter of drive wheel 120 is 425 mills with a circumference of about 1335 mills. Drive wheel 120 therefore takes almost two full revolutions to move a card through the chute. The motor pulley is 250 mills and the drive pulley is 1000 mills (4 to 1 ratio). Given these parameters a motor speed of no less than 450 rpm is desirable. Furthermore, a motor capable of delivering 500 rpm or better is desirable. Card present sensor 160 is located so that it senses the edge of the playing card, 250 mills before the edge of the card reaches the read station head. At 450 rpm, this equates to 100 ms.

Figure 6:
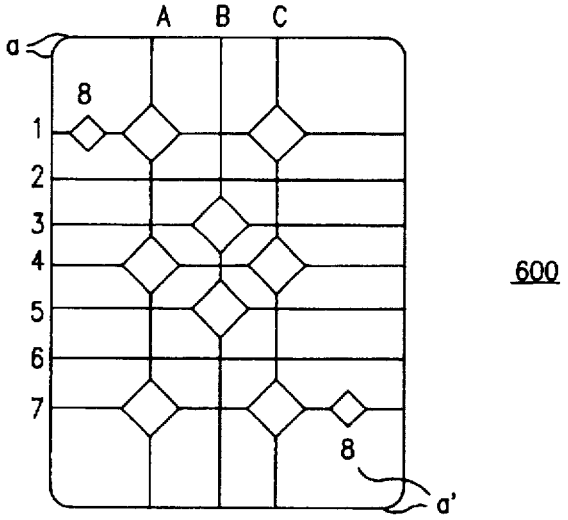
FIG. 6 is an illustration of a typical playing card showing the arrangement of various spots on that playing card.

A typical playing card is shown in FIG. 6. Traditionally playing cards have spots on each card, the number of spots represent the value of the card for all non face cards. In the example of FIG. 6, there are eight spots on card 600. The cut of a standard playing card is 3.5"×2.5" and is accurate to about 10 mills. The position of the print in relation to the edges of the card is known as centering. In the card 600 shown in FIG. 6, the vertical centering is tested by measuring a and $a^1$, a perfect card would have the same measurement. Typical vertical errors range from 50–75 mills. Horizontal centering errors seldom exceed 25 mills.

As shown, there is a great deal of symmetry with the spots on a playing card. Referring to the vertical spots as columns, there are three shown for card 600 in FIG. 6. Column A is on the left, column C is on the right. Column C always duplicates column A. If the card is divided horizontally into seven equally spaced rows, then any spot in column A row 1 is repeated in column A row 7. Column C follows the pattern of column A and is ignored in the following discussion. Furthermore, any spot in column A row 3 is repeated in column A row 5. Because duplicate samples can be eliminated, determination of the value of any card in the deck can be based solely on rows 1, 3, 4 and 5.

Table IV illustrates the coordinate system for a playing card. The spots are named by the row they are located on. For example, spot 1 refers to any spot positioned on row 1, spot 2 on row 2, etc.

Columns A and B are desirably sampled separately. Table I below is a truth table showing how the two columns work together. A 0 indicates no mark or spot in a sampled location. A 1 indicates there is a spot in a sampled location. An X indicates that the sampled location is not used or the presence of a mark in a sampled location cannot be determined.

TABLE IV

| Col A | | | | | Col B | | | | | | |
|---|---|---|---|---|---|---|---|---|---|---|---|
| Row | 1 | 2 | 3 | 4 | Row | 1 | 2 | 3 | 4 | 5 | Card Value |
| | 0 | x | 0 | 0 | | 0 | x | 0 | 0 | x | Bad Read |
| | 0 | x | 0 | 0 | | 0 | x | 0 | 1 | x | Ace |
| | 0 | x | 0 | 0 | | 1 | x | 0 | 0 | x | Two |
| | 0 | x | 0 | 0 | | 1 | x | 0 | 1 | x | Three |
| | 1 | x | 0 | 0 | | x | x | 0 | 0 | 0 | Four |
| | 1 | x | 0 | 0 | | x | x | 0 | 1 | 0 | Five |
| | 1 | x | 0 | 1 | | x | x | 0 | 0 | 0 | Six |
| | 1 | x | 0 | 1 | | x | x | 1 | 0 | 0 | Seven |
| | 1 | x | 0 | 1 | | x | x | 0 | 0 | 1 | Seven |
| | 1 | x | 0 | 1 | | x | x | 1 | 0 | 1 | Eight |
| | 1 | x | 1 | x | | x | x | 0 | 1 | 0 | Nine |
| | 1 | x | 1 | x | | x | x | x | 0 | x | Ten |
| | x | x | 1 | 1 | | x | x | 1 | 1 | 1 | Face Card |

The read station translates the dark spots into a logical 1 in the control logic, no spot translates to a logical 0. As the card is moved across the read station column A and column B are sampled, the ones and zeros are compared to the truth table to compute the value of the card.

Figure 7:
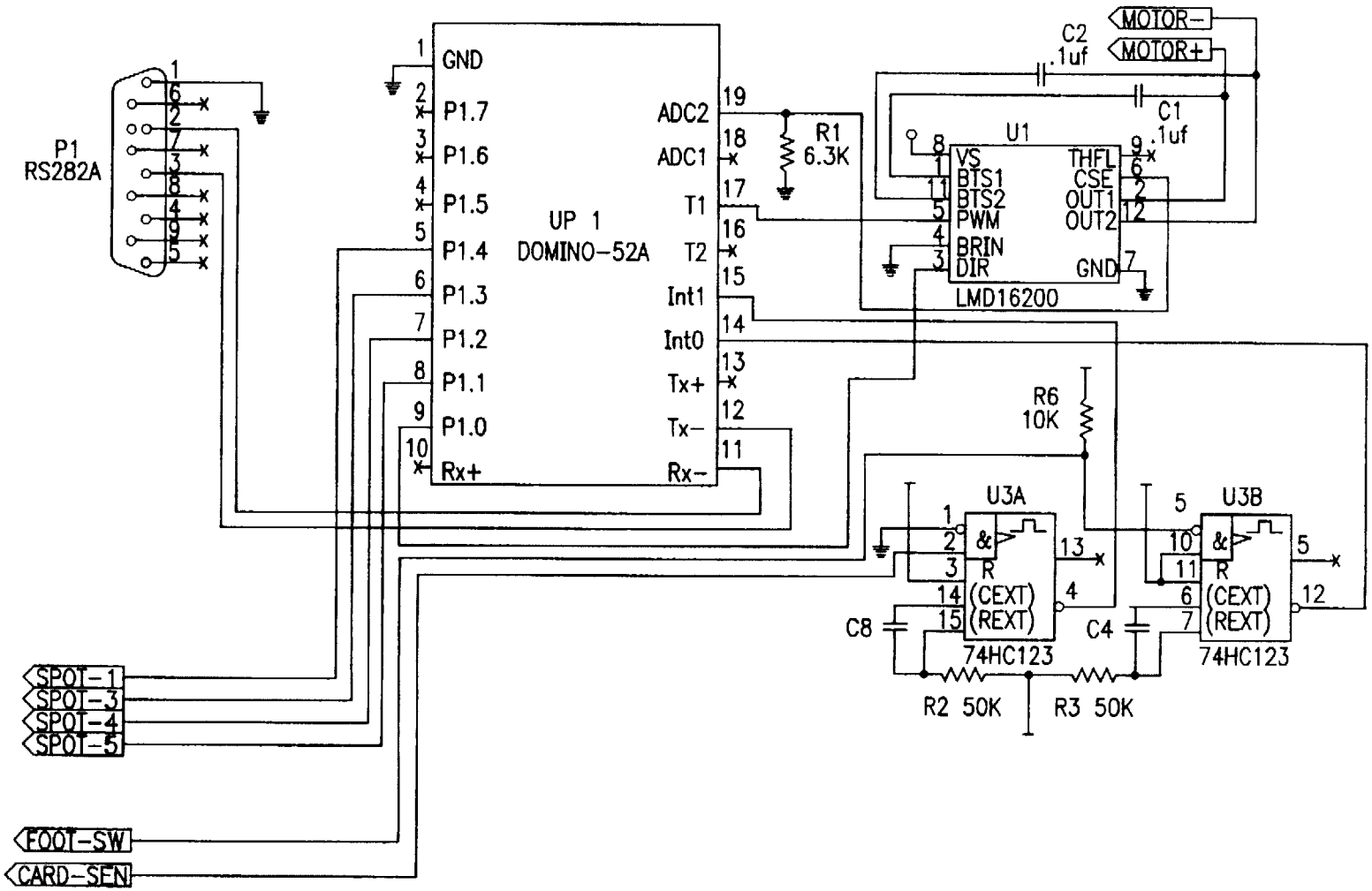
FIG. 7 is a circuit diagram which illustrates the controller of the automated dealing shoe in accordance with an exemplary embodiment of the present invention.

A schematic representation of the control circuitry for Automated Dealing Shoe 200, in accordance with an exemplary embodiment of the present invention is shown in FIG. 7. As shown, a LMD 18200 H Bridge device, manufactured by National Semi Conductor, is used to control the drive motor. The LMD 18200 H Bridge device has a pulse width modulated input pin 5 back to pin 17 on the DOMINO 52 to allow for control of motor speed. The lower the duty cycle of the signal provided to this pin, the slower the speed. The LMD18200 allows for speed control, breaking and direction of travel. The inputs for this device come from the control microprocessor, which, in this example, is a Domino-52a. The control microprocessor, on initialization uses the signal CARD-SEN provided by the card presence sensor to determine that a card is positioned in exit chute 104. If the card is not present, the microprocessor signals the drive motor which advances the card using a duty cycle of 60% until the card is detected. If the card is detected at startup, the microprocessor transmits a reverse signal to the DIR input of the LMD 18200 which "backs up" the card until card presence sensor 160 no longer "sees" the card, then advances it as above. This positions the first card.

When the microprocessor detects a card advance switch closure signal, FOOT-SV, the microprocessor goes into a timing loop setting it's internal timer and pulsing the PWM (pulse width modulation) line on the LMD 18200 to advance the card until card presence sensor 160 changes state, indicating that the card has been delivered. At this time, the microprocessor stops the motor. The card has now reached its furthest point of travel to the extent that the drive wheel is unable to exert sufficient force to move it forward any more. At this time, the drive wheel starts to come in contact with the next card in the deck. The front card is sitting in position, ready for the dealer to dispense, and stops the motor. The microprocessor then advances the next card to exit chute 104 for the next cycle.

An output from the LMD18200 which is input to the Domino 52a processor is the ADC0 line which is an analog to digital converter input. The Domino 52a processor uses this line to determine the current consumption of the motor and subsequently the acceleration and speed. The motor has stalled if the full scale input voltage of 5 volts has been reached. If no voltage is registered then the motor circuit is open. The sample is taken on the A/D converter ADCO pin 19. R1 has been calculated for a stall current of 1000 ma. Resistor R1 is adjusted so that the maximum current allowed by the motor produces five volts at the AN0 input.

A duty cycle of 90% is maintained until the current is at a predetermined level. The processor then reduces the duty cycle to 60% and continually adjusts the duty cycle every 1 ms (millisecond) to keep the speed constant during the read cycle. If the motor should stall for any reason, the microprocessor detects this condition and shuts off the motor. If the microprocessor sends a command to start the motor and no current is detected, then the motor circuit is open. Errors will be sent to the host computer system for processing.

A special set of playing cards are used for the calibration of the motor speed by the Domino 52C. These calibration cards are all black with a white strip down the center of the card 50 mills wide. The calibration deck is placed in the shoe, a diagnostic program is loaded into the Domino 52C through the RS232 port.

The diagnostic program performs the following operations:

Turns on the motor.

Waits for the card present sensor (through interrupt 1)

Samples the read station input until the state changes.

Stores the timer and PWM variables.

Samples the read station input until the state changes.

Turns off the motor

Reports the activity

Repeats the process until the time from motor start to the card being present is 100 ms and the time from the card being present to the read station state change is 490 ms.

Once the samples are collected, the event times are reported to the connected terminal and adjusted by setting the duty cycle parameters until the ideal time of 100 milliseconds from card sense to dark space and 490 milliseconds from card sense to white space is reached. Upon completion, the parameters may be set in non volatile memory located in the DOMINO 52 (not shown). This technique may be used to test the motor drive during maintenance or production and also allows for a variety of different motors to be used without having to reprogram each one.

Figure 8:
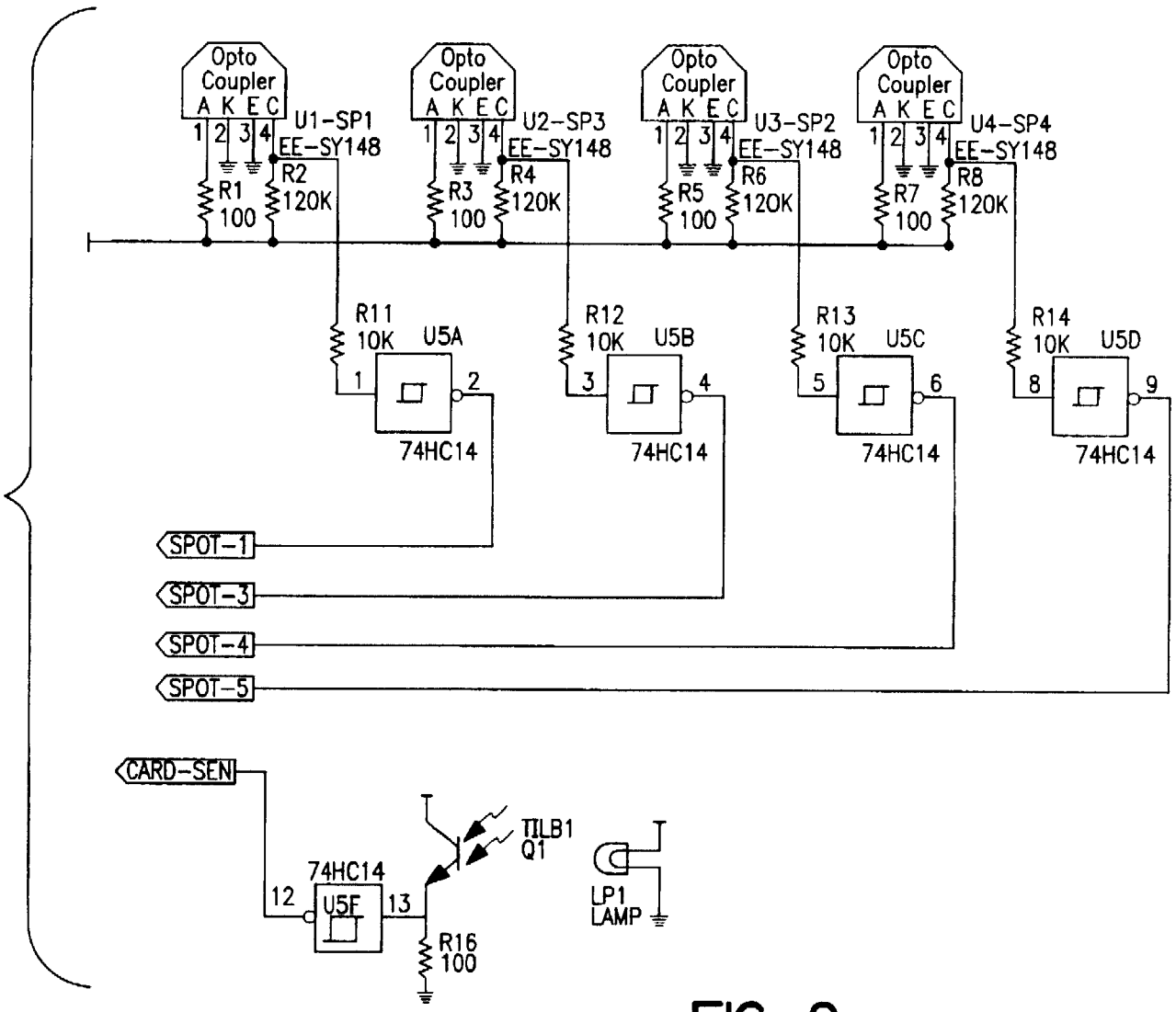
FIG. 8 is a circuit diagram which illustrates the read station of the automated dealing shoe in accordance with an exemplary embodiment of the present invention.
Figure 10:
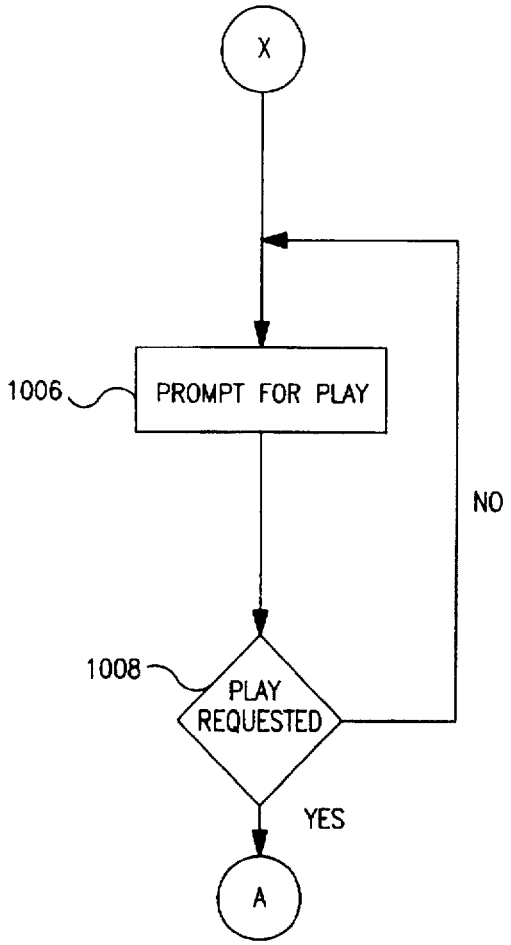
FIGS. 9–13 are flowchart diagrams which illustrate operation of game play in accordance with an exemplary embodiment of the present invention.

The portion of control circuitry which actually reads the cards is shown in FIG. 8. Four sensors (e.g., EE-SY1148, manufactured by the Durron Company) are used in an exemplary embodiment to read the spots on the playing cards. Pins one and two are internally connected to a led which illuminates the surface of the playing card as it moves through the exit chute of automated dealing shoe 200. R1 R3 R5 and R7 are connected to the five volt supply and are used to limit the current to the LEDs on dealing shoe 200. Pins three and four are connected internally to the emitter and cathode of an optically excited transistor. R2 R4 R6 and R8 are connected to the five volt supply and are used to set the quiescent current to the optical transistors. R11 R12 R13 and R14 are connected to the input of a 74HC14 hex inverter and are used to set the sensitivity of the read station. the 10K value has been chosen so that the inverter will change state when a red card passes across the station head, producing a positive voltage at the spot sensor output terminal. When the white portion of the card is over the read head, the sensor is inactive and the output terminal is at or near zero volts. Each of the four sensors is connected to a labeled output post that relates to the portion of the card it samples. Spot 1, 3, 4 and 5.

An opto transistor (e.g., TIL81, manufactured by Texas Instruments) is used to determine that a card is present at read station 150. When no card is present, lamp LP1 (which is always illuminated) excites Q1 which causes current flow through R16, placing a positive voltage across U5F pin 13, which is the input of an inverter. When the input is positive the output is driven low, therefore when no card is present at read station 150, the signal CARD-SEN output is low. When a card is present, the light from LP1 is interrupted, shutting off Q1, the 100 ohm resistor is close enough to ground so that when no current is flowing due to Q1, a zero voltage is seen at the input of U5F and therefore the output goes high.

A one shot (e.g., 74HC123) is used to condition the input to the microprocessor. The FOOT-SW input signal is from a switch that places the input to ground. When the FOOT-SW input signal goes to ground U3B produces a 100 ms output pulse to the interrupt 0 input of the Domino 52C microprocessor. The microprocessor, upon reception of the INTO signal starts the motor and waits for the CARD-SEN signal to produce a negative going 100 ms pulse on the INT1 input line, signaling that a card has arrived in the chute. The microprocessor sets it's internal timer to 350 ms., when it is exhausted it reads the spot sensors and stores the column A results. The timer is then set again to 250 ms. (-process time of about 10 ms) and when this timer is exhausted the card will be over the column B spots. the spot sensors are read again. The microprocessor now sets it's internal timer to 400 ms when this timer is exhausted the motor drive is shut off. At this point the card value is calculated and broadcast to the host system over the RS232 Port connection at P1. The reader is now ready for another cycle. The CARD-SEN input signal is conditioned by U3A, this one shot ensures that only a new card will produce an interrupt on the INT1 wire.

The microprocessor sends status and card data at the completion of every read cycle by way of an RS232 asynchronous link. All data is desirably converted to ASCII. Each message will contain 12 bytes as follows:

Bytes 1 and 2 are the characters "A0"

Bytes 3 and 4 are one of the following sets of characters:

EO indicating a good read

E1 motor jam

E2 no motion from motor

E3 inconsistent read

Bytes 5 and 6 are the Card's Value [ASCII 00–12]

Byte 7 shall be the Card's Suit ([ASCII 1–4]

Bytes 8 and 9 are the read counter sequence number [ASCII 00–15]

Bytes 10 and 11 are the two bytes XOR checksum

Byte 12 is NULL

By communicating with the dealer's processing subsystem **210*b*** in this manner, each card may be identified by the system as it is distributed.

Dealing shoe 200 may also be used with other card games. Furthermore, dealing shoe 200 may also be used with card games in which the particular suit of at least certain cards is relevant. Recognition of card suit may be accomplished using, for example, forms of optical character recognition whcih are well known to one of ordinary skill in that art.

Game playing in accordance with one embodiment of the present invention is accomplished as follows. Initially, each player's touch screen is in an inactive status with a preprogrammed display (e.g. a promotional display) running. The player may then insert an identification card into the card reader (or simply touch the screen if he does not possess an identification card) to indicate that he is ready to play. One of the LEDs will illuminate on the touch screen to indicate to the dealer that the player is ready to play. This information may also be displayed on the dealer's touch screen. Before a new hand is played, the dealer may accept various forms of monies, such as currency, coupons or chips and place them bill/coupon reader **210*c*. The dealer's screen may prompt the dealer to indicate the playing station 201–207 which is to be credited with the monies deposited into the bill/coupon reader 210*c*. Upon the dealer indicating the appropriate playing station, that playing station may indicate the amount being credited and invite the player to confirm that the amount being credited is correct. Once the player and the dealer agree that the amount of the monies counted by bill/coupon reader 210*c*** is correct, funds would be approved and transferred onto the betting station. The playing station is now ready for game playing.

On each active screen, a set of Dollar value bet buttons may appear, e.g. $5, $10, $25, etc. Available credit may also be displayed. Each player may touch the location on his screen corresponding to the amount of the bet he wishes to make. A field may be touched multiple times to increase the amount of the bet. A cancel feature is also available to erase an entered bet and to start over. As bets are made, these bets are deducted from the total credit available.

A side bet feature may also be available for players to place a bet for the dealer's toke (tip) if the player wins. If a toke field is selected, monetary amount fields may appear for the player to place a bet for the dealer's toke.

After all bets are placed, the dealer may touch a "deal" field on the dealer's screen. This prevents all entered bets from being changed, and locks out all new bets. The dealer may then begin to deal (by either removing the first card from the betting shoe or pressing the deal switch for the first card to be dispensed). Also, once the first card is dealt, a plurality of new fields would appear on each players' touch screen. For blackjack, the fields may be hit, stand, split, double down, insurance, etc. The rules of the particular game being (played dictates the fields which appear and when each field may be activated. The rules vary for each game and are described, for example, in Bally's Gaming Guide, Bally's Park Place Casino Hotel and Tower, Atlantic City, N.J., 1996 which is incorporated herein by reference).

As an example, an extra field could be displayed to make available a separate bet for a chance at a progressive jackpot.

As a further example, once the appropriate number of cards have been dealt to each location, each player may be prompted from the next set of appropriate choices. For blackjack, this may be: Hit, Stand, or Split. If a Split is chosen, then the screen may be divided into two sections with separate hands, prompts and monetary calculations. In such a situation, a player may hit or stand for each hand separately.

Once all of the patron stations have completed their play, win or lose, monetary amounts may be added or subtracted to each players credit total and displayed on each players' touch screen.

Operation of the present invention is illustrated by the flowchart diagrams which appear in FIGS. 9–13.

Figure 9:
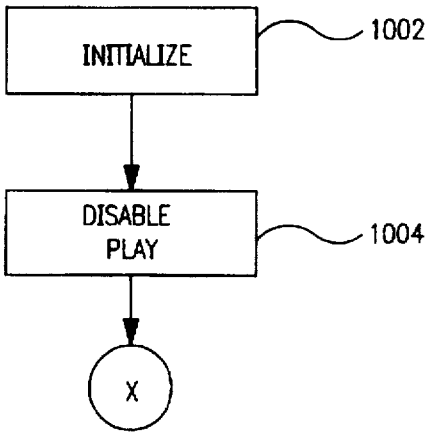
Figure 11:
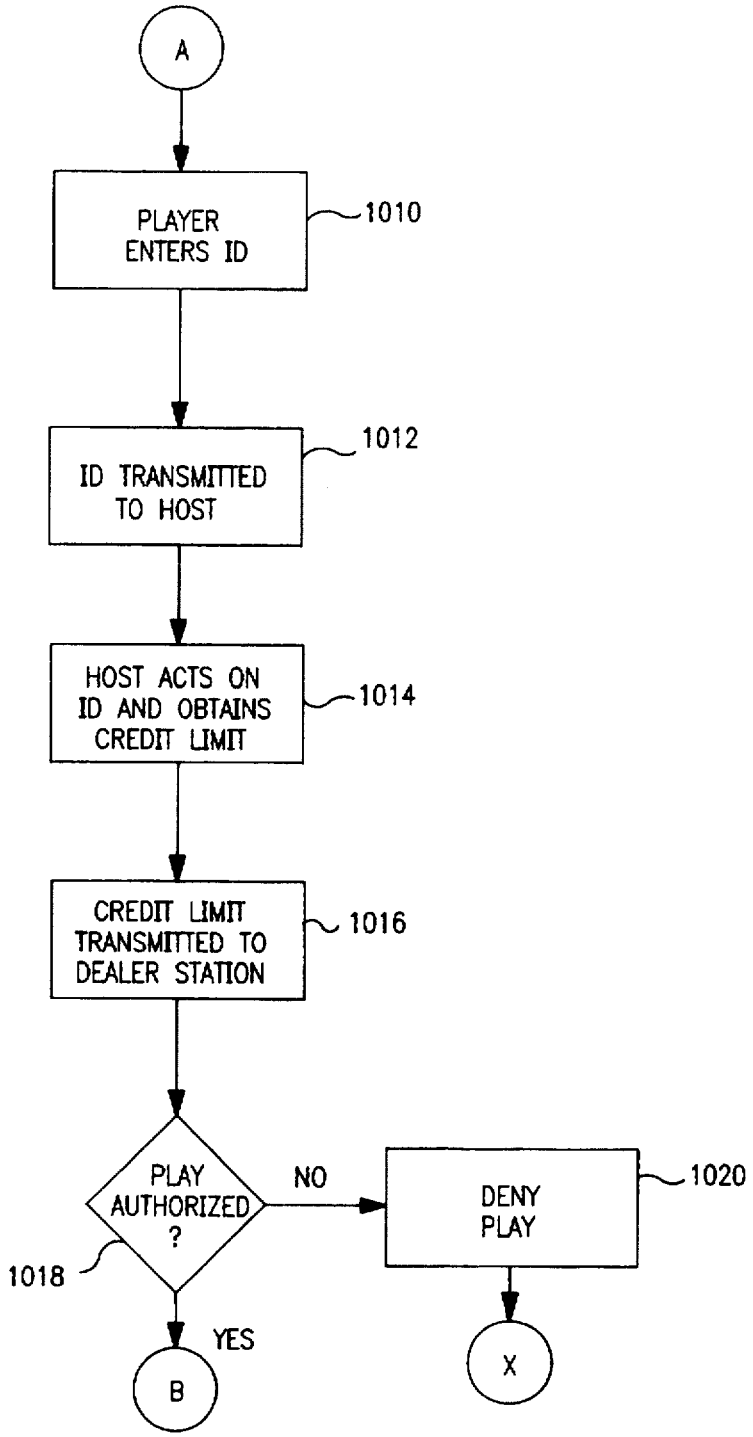
Figure 12:
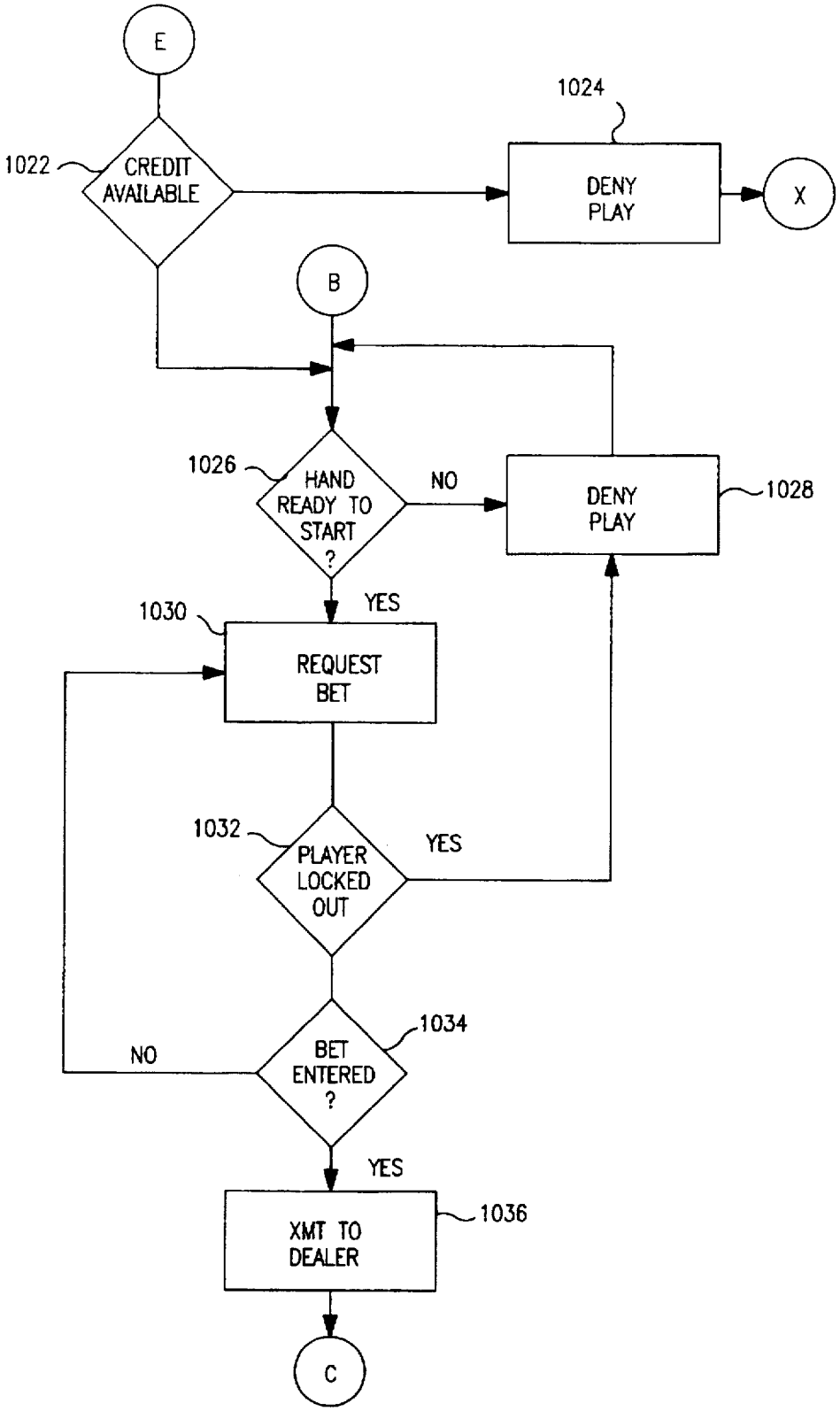

As shown in FIG. 9, step 1002, the system is initialized. This may include the step of inserting the special set of playing cards into automated dealing shoe 200 in order to calibrate the dealing shoe's motor speed. Also, all touch screens may be initialized and the values of all variables set to zero (or as appropriate). At step 1004, the ability to initiate game play on all of the touch screens is disabled. Processing continues to FIG. 10 via off-page connector X. At step 1006, all touch screens begin prompting players to begin game play. At step 1008, if players do not request that game playing begin, then processing returns to step 1006. Otherwise, processing proceeds to FIG. 11 via off-page connector A. At step 1010, the player enters his identification. This may be accomplished, for example, by inserting an identification card into an appropriate card reader. At step 1012, the player's identification is transmitted from the card reader to the host computer. At step 1014, the host authorizes a credit limit. This may be accomplished in several ways. One method is to have a credit limit stored and updated in the identification card. Thus, this credit limit is transmitted from the card reader to the host. Another method is for the casino operator to provide a credit limit. This may be obtained from information previously obtained by the casino operator. At step 1016, the credit limit is transmitted to the players processing subsystem. At step 1018, if the credit limit is zero (e.g., play is not authorized), then at step 1020, play is denied. If play is denied, the player is provided a message indicating the play is denied. Then, processing proceeds to step 1006 via off-page connector X at which time the player is once again prompted to begin play. If, at step 1018, play is authorized, then processing proceeds to FIG. 12, step 1026, via off-page connector B. At step 1026, the player is not permitted to enter a bet until a new hand is ready to start. If the hand is not ready to start, then, at step 1028, play is denied. Processing proceeds between steps 1026 and 1028 until a new hand is ready to start. When a new hand is ready to start, at step 1030, the player is requested to enter a bet. At step 1032, the player's processing subsystem receives a signal from the dealer's processing subsystem that bets are now locked out. This signal will not be transmitted until the dealer indicates that he is ready to deal a hand. Until the player transmits this signal, processing proceeds between steps 1030 and 1034 at which the processing subsystem requests a player to bet and the player actually enters the bet until, at step 1032, the player is locked out from entering a further bet. Thus, once the player is locked out then processing proceeds to step 1028 where play is denied. The player must wait for another hand to start before he can enter another bet. At step 1034, if a bet is entered then, at step 1036, the bet is transmitted to the dealer's processing subsystem.

Figure 13:
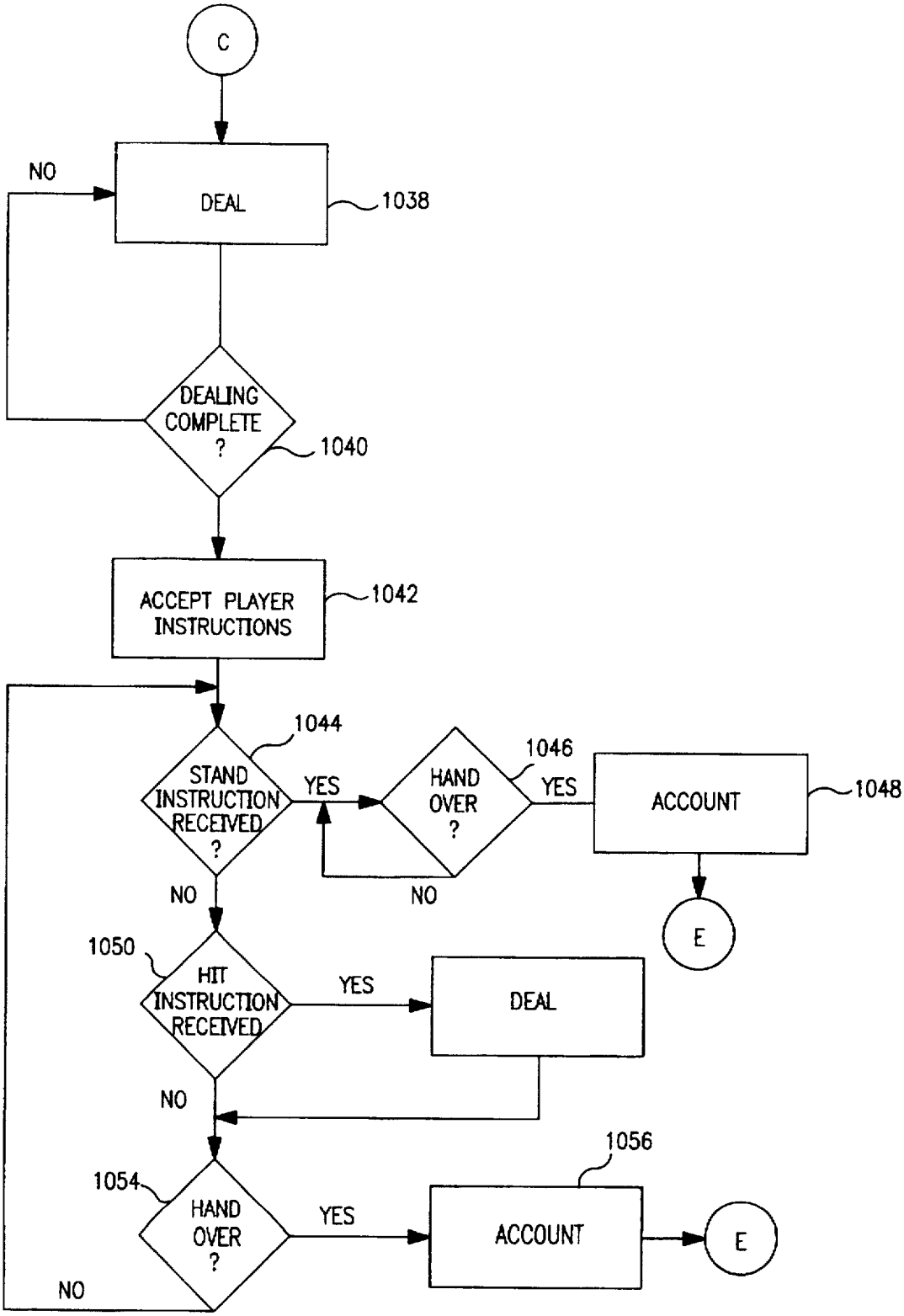

Processing proceeds to FIG. 13, step 1038, via off-page connector C. At step 1038, the dealer deals. This is accomplished by advancing playing cards through the automated dealing shoe 200. The dealer continues to deal until, at step 1048, dealing is complete. The dealer can indicate that dealing is complete, for example touching an appropriate location on his touch screen. Once dealing is complete, at step 1042, the players processing subsystem receives the player's instructions. Exemplary instructions are illustrated by FIG. 14. For example, the player may choose to stand (step 1044), hit (step 1050), or at step 1054 the hand is over. If, at step 1044, the player chooses to stand, then, after the hand is over at step 1046 then, at step 1048 the player's win or loss is accounted for. This amount is added or subtracted to the player's available credit at step 1022 via off-page connector E. Similarly, at step 1054, if the hand is over, then, at step 1056 there is an accounting and again at step 1022 the player's available credit is updated.

Before a new hand is dealt, a "cash out" field may be available on each player's touch screen. If activated, the amount of the cash out and the patron station requesting the cash out may be displayed on the Dealers touch screen. The dealer may then authorize a coupon to be printed for the appropriate amount. A bonus may also be provided to the player at that time.

While the above description has specified the use of touch screens, one of ordinary skill in the art would recognize the other type of I/O devices to allow each player to interact with the dealer and to play the particular card game. For example, either mechanical buttons or electronic sensors could be utilized for those functions. Thus, sensors could be positioned in the card delivery area so that players could interact with the dealer as in the past. The instructions hit, stand, double down, split (for example) could be tracked through the sensors.

Various other subsystems may be added. The present invention may be used, for example, with a bonus meter 220 as shown in FIG. 2. Such a subsystem can monitor a side bet or a bet reaching a predetermined amount and can allow the player to be eligible to win a monetary award that is incremented by a percent of the bet placed (hence, a progressive meter). The wining of the bonus meter could entail specific combinations of cards or values. Prizes may be awarded (such as a car), or a specific dollar amount or a random dollar amount that is between given values that a random numbers generator picks may be awarded. Such subsystems could be connected to more than one table and also to more then one casino.

Furthermore, in accordance with the present invention, it is possible to monitor as many tables as desired. In this manner, it is possible to monitor:

Win/loss accounting for each table game.

Win/loss accounting for each customer.

Dealer proficiency.

Flow of monies.

Cheating.

Because all cards are electronically identified, it is possible to obtain a visual image of the cards being dealt at any given table or to any given person.

According to another aspect of the present invention, an easily accessible mechanism may be provided so that patrons may move from table games to slots or from slots to the table games without having to go through the procedure of cashing in their chips, coins or tokens and repurchasing different ones needed to play that particular game. This can be accomplished through the ability to record the cash flow of patron in the form of credits as more clearly set forth below.

There are several different techniques that can be utilized to accomplish this transfer, including:

1) Read and write credit card technology, where the credit card is a self-contained data information system which is capable of maintaining its own accessible and updatable information. A monetary value (a "credit") may be stored in the card. The credit may be transferred into a game for the player's use before the game begins. The credit may be transferred from the game back into the card when the player has concluded playing the game. The player can then take the card to another game for resumption of play.

2) Main computer logging and accounting that is capable of tracking and storing credits, downloading the funds to a particular game or spot on a table before play begins and uploading the funds back to the main computer when play is completed. A unique registration code or an encoded card can be used by a player to initiate downloading and uploading.

3) Coupons that are printed with any remaining credits when a player wishes to leave a particular game. Those coupons could then be inserted in a reader associated with a next game that the patron wishes to play so that the credits can be used for that next game.

At the time a player wishes to obtain cash (i.e. the player has completed playing) consolidated pay-out stations can be used for transferring credits into cash. Such a consolidated pay out station can be used regardless of the form of credit transfer used between games. The coupons may be designed (using for example bar code technology) so that the coupons can be interchangeable not only from Table Game to Table Game, but between Slot Machines and Table Games and Table Games and Slot Machines.

Thus, in accordance with the present invention, it is possible to print a coupon and/or read currency to establish credit for play. When fully optioned, a secure environment is provided by reducing the chip handling by a dealer. Furthermore, by increasing the number of hands that may be dealt during the dealer's shift, profitability may be improved. In addition, the identification of a player to a computer system allows for all types of marketing arrangements based on his play.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. Apparatus for playing a plurality of games based upon a plurality of cards comprising:

an automated dealing shoe for dispensing each of said plurality of cards and for recognizing each of said plurality of cards as each is dispensed;

player station means for a plurality of players to:

a) each enter a respective bet;

b) each request that a respective next one of said cards be dispensed or not dispensed to each respective one of said players;

c) each have converted each respective bet into a respective amount of win or a respective amount of loss responsive to said plurality of cards dispensed by said automated dealing shoe; and d) each have their respective amount of win or respective amount of loss tracked for each of said plurality of games.

2. Apparatus according to claim 1, wherein a dealer dispenses each of said cards to each of said players, and said player station means includes means for indicating to said dealer whether a next one of said cards should be dispensed to a respective one of said players.

3. Apparatus according to claim 1, wherein said player station means includes means for each one of said players to identify himself.

4. Apparatus according to claim 1, wherein said player station means includes chip counting means for counting a plurality of chips and for applying at least a portion of the value of said chips towards one of said bets.

5. Apparatus according to claim 1, further comprising control station means for identifying a dealer dealing said plurality of cards.

6. Apparatus according to claim 5, wherein said control means is further for determining dealing proficiency of said dealer.

7. Apparatus for playing a game based upon a plurality of cards in accordance with claim 1, wherein each of said cards has a respective card value identified by one of spots and face card markings thereon, the spots arranged in at least one of a plurality of columns and at least one of a plurality of rows, and wherein said automated dealing shoe comprises:

a) a plurality of sensors, each arranged relative to a respective one of said plurality of rows;

b) advancement means for advancing one of said cards towards and across said plurality of sensors;

c) detection means for detecting whether there exists one of a) spots and b) face card markings at a first one and a second one of said plurality of columns as said one of said cards is moved across said plurality of sensors by said advancement means; and d) deter means for determining said card value of said one of said cards based upon whether any spots and any face card markings are detected by said detection means.

8. Apparatus according to claim 7, wherein said detection means detects whether there exists one of a) spots and b) face card markings at only said first one and said second one of said plurality of columns.

9. Apparatus for playing a game based upon a plurality of cards comprising:

an automated dealing shoe for dispensing each of said plurality of cards and for recognizing each of said plurality of cards as each is dispensed;

player station means for a plurality of players to:

a) each enter a respective bet;

b) each request that a respective next one of said cards be dispensed or not dispensed to each respective one of said players; and c) each have converted each respective bet into a win or a loss responsive to said plurality of cards dispensed by said automated dealing shoe, wherein said player station means includes input means for inputting monetary tender which is useable towards each of said bets.

10. Apparatus for playing a game based upon a plurality of cards comprising:

an automated dealing shoe for dispensing each of said plurality of cards and for recognizing each of said plurality of cards as each is dispensed;

player station means for a plurality of players to:

a) each enter a respective bet;

b) each request that a respective next one of said cards be dispensed or not dispensed to each respective one of said players; and c) each have converted each respective bet into a win or a loss responsive to said plurality of cards dispensed by said automated dealing shoe, wherein said player station means includes output means for outputting monetary tender which is useable towards each of said bets.

11. A method of playing a plurality of games based upon a plurality of cards, comprising the steps of:

a) receiving from a plurality of players a respective plurality of bets on a respective plurality of player betting stations wherein said respective plurality of bets correspond to a respective plurality of bet signals;

b) providing a plurality of signals to a dealer control station by said plurality of player betting stations that all of said players have entered their respective bets;

c) signaling from each of said player betting stations one of a bet entered signal and a hit signal;

d) dispensing ones of a plurality of cards by providing corresponding signals to each of said player betting stations responsive to at least one of said bet entered signal and said hit signal;

e) recognizing each of said plurality of cards as each is dispensed;

f) converting each of said bet signals to one of an amount of win and an amount of loss depending on which ones of said cards are dispensed to each of said players; and g) tracking each amount of win or amount of loss for each of said players for each of said plurality of games.

12. A method according to claim 11, further comprising the step of indicating on each of said player betting stations whether each of said respective players 1) has entered their bet; and 2) is requesting a hit.

13. A method of betting on respective multiple games by a player at respective multiple physical locations, comprising the steps of:

a) making credit available for said player, by generating a signal corresponding to credit available, at any of said locations to enable said player to play any of said games;

b) adjusting said credit after said player has played any of said games;

c) transmitting said signal so that credit is available at another of said locations; and d) repeating steps b) and c) for different of said games at different of said locations, wherein ones of said games are controlled by a human dealer.

14. A method of betting on respective multiple games by a player at respective multiple location, comprising the steps of:

a) receiving at one of said locations a credit value signal corresponding to a credit value for said player;

b) adjusting said credit value correspondingly to results of one of said games played at said respective one of said locations;

c) transmitting an adjusted credit value signal corresponding to said adjusted credit value so that said adjusted credit value may be received at another of said locations;

d) receiving said adjusted credit value signal at said another of said locations;

e) adjusting said adjusted credit value correspondingly to results of another of said games played at another respective one of said locations, wherein ones of said games are controlled by a human dealer.

15. A method of betting on respective multiple games according to claim 14, wherein steps c), d), and e) are repeated for different games at respectively different locations.

16. A method of betting on respective multiple games according to claim 14, wherein steps c) and d) together include the step of electronically transferring a signal between said one of said locations and said another of said locations.

17. A method of betting on respective multiple games according to claim 16, further comprising the step of generating said signal corresponding to said credit value and displaying said credit value.

18. A method of betting on respective multiple games according to claim 16 wherein said signal indicates at least one a) actual credit and b) whether there is sufficient credit for said player to bet.

19. A method of betting on respective multiple games according to claim 14, wherein step c) includes the step of fixing the credit value in a physical medium so that the player can transfer the credit value to another of said locations by physically moving the physical medium.

20. Apparatus for betting on respective multiple games by a player at respective multiple physical locations, comprising:

means of receiving at any of said locations a credit value for said player;

means for adjusting said credit value correspondingly to results of any of said respective multiple games at any of said respective multiple locations; and means for generating a signal corresponding to said credit value for transfer of said credit value between one of said locations at which at least one of said games is controlled by a human dealer and another of said locations.

21. Apparatus for betting on respective multiple games by a player at respective multiple physical locations, further comprising:

means for maintaining a credit value for application of said credit value for said player at any of said plurality of locations;

means for adjusting said credit value correspondingly to results of any of said respective multiple games at any of said respective multiple locations;

means for indicating at any of said locations at which at least one of said games is controlled by a human dealer at least one of a) said credit value, and b) whether said credit value is sufficient for said player to bet at said any of said locations.

22. Apparatus for playing a plurality of games at a location based upon a plurality of cards comprising:

an automated dealing shoe for dispensing each of said plurality of cards and for recognizing each of said plurality of cards as each is dispensed;

player station means for a plurality of players to:

a) each enter a respective bet;

b) each request that a respective next one of said cards be dispensed or not dispensed to each respective one of said players; and c) each have converted each respective bet into a win or a loss responsive to said plurality of cards dispensed by said automated dealing shoe; and means for receiving a credit value for at least one of said players, adjusting said credit value based on said win or said loss, and transferring said credit value to another location for playing further games which is controlled by a human dealer.

23. Apparatus according to claim 22, wherein a dealer dispenses each of said cards to each of said players, and said player station means includes means for indicating to said dealer whether a next one of said cards should be dispensed to a respective one of said players.

24. Apparatus according to claim 22, wherein said player station means includes means for each one of said players to identify himself.

25. Apparatus according to claim 22, wherein said player station means includes input means for inputting monetary tender which is useable towards each of said bets.

26. Apparatus according to claim 22, wherein said player station means includes output means for outputting monetary tender which is useable towards each of said bets.

27. Apparatus according to claim 22, wherein said player station means includes chip counting means for counting a plurality of chips and for applying at least a portion of the value of said chips towards one of said bets.

28. A method of playing a game at a location based upon a plurality of cards, comprising the steps of:

a) receiving from a plurality of players a respective plurality of bets on a respective plurality of player betting stations wherein said respective plurality of bets correspond to a respective plurality of bet signals;

b) providing a plurality of signals to a dealer control station by said plurality of player betting stations indicating that all of said players have entered their respective bets;

c) signaling from each of said player betting stations one of a bet entered signal and a hit signal;

d) dispensing ones of a plurality of cards by providing corresponding signals to each of said player betting stations responsive to at least one of said bet entered signal and said hit signal;

e) recognizing each of said plurality of cards as each is dispensed; and f) converting each of said bet signals to one of an amount of win and an amount of loss depending on which ones of said cards are dispensed to each of said players;

g) adjusting a credit value for each of said players based on each amount of win or amount of loss; and h) transferring a credit value signal corresponding to said credit value for at least one of said players to a further location so that a further game which is controlled by a human dealer may be played.

29. A method according to claim 28, further comprising the step of indicating on each of said player betting stations whether each of said respective players 1) has entered their bet; and 2) is requesting a hit.

* * * * *

UNITED STATES PATENT AND TRADE MARK OFFICE

CERTIFICATE OF CORRECTION

PATENT NO. : 5,779,546
DATED : July 14, 1998
INVENTOR(S) : Meissner et al.

It is certified that error appears in the above-identified patent and that said Letters Patent is hereby corrected as shown below:

Column 16, line 26, "deter" should read --determining--.

Signed and Sealed this

Fifteenth Day of June, 1999

*Attest:*

Q. TODD DICKINSON

*Attesting Officer*

*Acting Commissioner of Patents and Trademarks*